US008446335B2

(12) United States Patent
Frank

(10) Patent No.: US 8,446,335 B2
(45) Date of Patent: May 21, 2013

(54) MOUNTING AN ANTENNA SYSTEM TO A SOLID SURFACE

(71) Applicant: Cisco Technology, Inc., San Jose, CA (US)

(72) Inventor: Timothy A. Frank, Parma, OH (US)

(73) Assignee: Csico Technology, Inc., San Jose, CA (US)

( * ) Notice: Subject to any disclaimer, the term of this patent is extended or adjusted under 35 U.S.C. 154(b) by 0 days.

(21) Appl. No.: 13/632,650

(22) Filed: Oct. 1, 2012

(65) Prior Publication Data

US 2013/0026325 A1 Jan. 31, 2013

Related U.S. Application Data

(62) Division of application No. 12/474,524, filed on May 29, 2009, now Pat. No. 8,305,286.

(51) Int. Cl.
*H01Q 1/12* (2006.01)

(52) U.S. Cl.
USPC ..... 343/878

(58) Field of Classification Search
USPC ..... 343/878, 872, 873, 720, 906
See application file for complete search history.

(56) References Cited

U.S. PATENT DOCUMENTS

| | | | | |
|---|---|---|---|---|
| 4,090,030 | A | 5/1978 | Lagasse | |
| 4,649,675 | A | 3/1987 | Moldovan et al. | |
| 5,229,784 | A | 7/1993 | Jones | |
| 5,456,433 | A | 10/1995 | Burns et al. | |
| 5,619,217 | A | 4/1997 | Mailandt et al. | |
| 5,738,324 | A | 4/1998 | Van Hout et al. | |
| 5,887,831 | A | 3/1999 | Post | |
| 6,295,036 | B1 | 9/2001 | Mata et al. | |
| 6,320,545 | B1 | 11/2001 | Nagumo et al. | |
| 6,806,832 | B2 | 10/2004 | Sato et al. | |
| 7,161,554 | B2 * | 1/2007 | Nugnes et al. | 343/878 |
| 7,443,360 | B2 * | 10/2008 | Chan | 343/872 |
| 7,446,725 | B2 * | 11/2008 | Song et al. | 343/789 |
| 7,946,082 | B2 * | 5/2011 | Ohkoshi et al. | 52/173.3 |
| 8,209,914 | B2 * | 7/2012 | Stearns et al. | 52/58 |
| 8,316,592 | B2 * | 11/2012 | Lanza | 52/173.3 |
| 2004/0066353 | A1 | 4/2004 | Ehlen et al. | |
| 2007/0278367 | A1 | 12/2007 | Batten | |
| 2009/0230827 | A1 | 9/2009 | Macall | |
| 2011/0068711 | A1 | 3/2011 | Spiro et al. | |

* cited by examiner

*Primary Examiner* — Huedung Mancuso
(74) *Attorney, Agent, or Firm* — Brinks Hofer Gilson & Lione

(57) ABSTRACT

A solid surface bracket is provided. The solid surface bracket is configured to couple an antenna system with a solid surface ceiling. The solid surface bracket may include a top flange, bottom flange, and a side flange. The top flange may include an opening that is sized and shaped to receive a solid surface screw. The solid surface screw may be configured to engage with the solid surface ceiling. The bottom flange may be configured to receive a clip of the antenna system. The bottom flange may extend substantially parallel to the top flange. The side flange may be coupled with the top flange and bottom flange. The side flange may extend between and substantially perpendicular to the top flange and bottom flange. The side flange may have a height greater than a minimum bend radius of a cable extending from the antenna system.

20 Claims, 4 Drawing Sheets

MOUNTING AN ANTENNA SYSTEM TO A SOLID SURFACE

PRIORITY CLAIM

This application is a divisional application of U.S. patent application Ser. No. 12/474,524 file May 29, 2009, which is incorporated by reference in its entirety.

FIELD

The present embodiments relate to mounting an antenna system to a solid surface ceiling.

BACKGROUND

An antenna system may be mounted to a suspended grid ceiling (i.e., a drop ceiling). A suspended grid ceiling is typically made of grid rails and ceiling tiles. The grid rails are suspended from a solid surface ceiling, for example, using wires or hangers. The ceiling tiles are held in place by the grid rails. Suspended grid ceilings are typically found in carpeted office spaces or residential homes. An antenna system may be attached to the grid rails. In order to do so, openings are formed in the ceiling tiles for antenna cables extending from a rear surface of the antenna system. Once routed through the openings, the antenna cables are routed between the solid surface ceiling and the ceiling tiles to a communication device, such as a router, access point, server, or network control box.

BRIEF DESCRIPTION OF THE DRAWINGS

The components and the figures are not necessarily to scale, emphasis instead being placed upon illustrating the principles of the invention. Moreover, in the figures, like-referenced numerals designate corresponding parts throughout the different views.

DESCRIPTION

Figure 1:
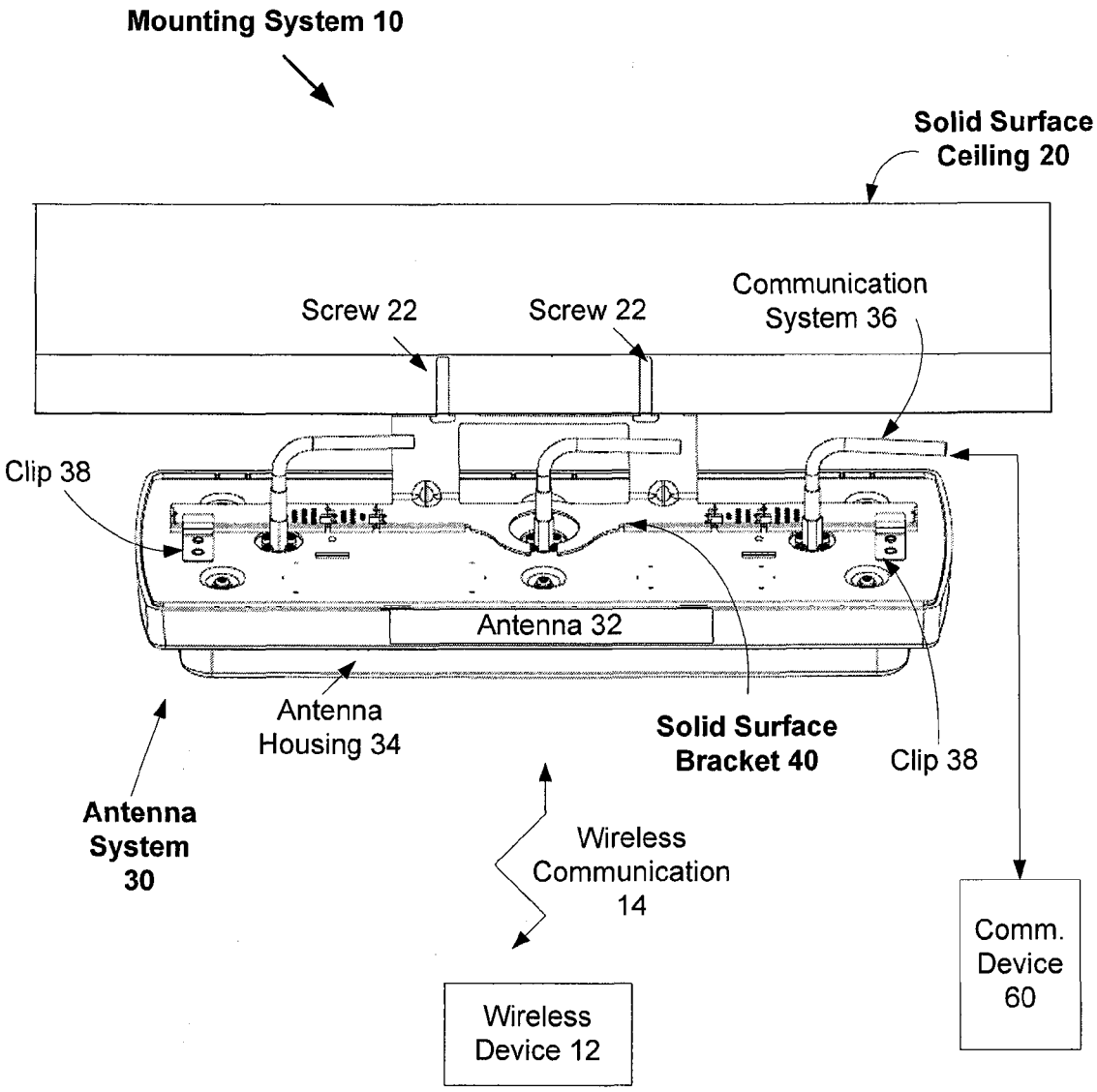
FIG. 1 illustrates one embodiment of an mounting system.

The present embodiments relate to mounting an antenna system to a solid surface ceiling. A solid surface bracket may be configured to mount the antenna system to the solid surface ceiling. A solid surface ceiling is a ceiling that has a thickness and/or material that prevents a through-hole from being formed in the solid surface ceiling. Exemplary solid surface ceilings are concrete ceilings, drywall ceiling, or wood ceilings. Solid surface ceilings may be found in, for example, warehouses, office buildings, commercial buildings, residential buildings, etc.

An antenna system may have one or more cables exiting from a rear surface. The solid surface bracket is configured to offset (i.e., with a gap or suspended region) the antenna system from the solid surface ceiling enough so that the coax cables may be routed to a communication device.

The solid surface bracket may engage with the solid surface ceiling and the antenna system. As used herein, the term "engage with" includes brought together and interconnected with or without movement. In order to engage with the solid surface ceiling, the solid surface bracket may include openings. The openings may be sized and shaped to receive a solid surface screw, such as a concrete screw, drywall screw, or wood screw. The solid surface screw may be used to fasten the solid surface bracket to the solid surface ceiling. The rear surface of the antenna system may include a clip. The clip may be sized, shaped, and configured to attach to a flange of the solid surface bracket. In order to engage the antenna system with the solid surface bracket, the clip may be slid over the flange. The flange may include a hem that prevents the clip from sliding off the flange.

One benefit of using the solid surface bracket is that antenna systems, which typically attach to suspended grid ceilings, may be attached to a solid surface ceiling without adjusting the configuration or design of the antenna system. Consumer confusion is reduced. The consumer does not need to be concerned with whether a solid surface antenna, with an adjusted configuration or design, or a grid mount antenna is being purchased. The consumer may purchase an antenna system configured to be installed in a suspended grid ceiling and use the solid surface bracket to attach the antenna system to the solid surface ceiling.

In one aspect, a solid surface bracket for coupling an antenna system with a solid surface ceiling is provided. The solid surface bracket may include a top flange, bottom flange, and a side flange. The top flange may include an opening that is sized and shaped to receive a solid surface fastener. The solid surface fastener may be configured to engage with the solid surface ceiling. The bottom flange may be configured to receive a clip or connector of the antenna system. The bottom flange may extend substantially parallel to the top flange. The side flange may be coupled with the top flange and bottom flange. The side flange may extend between the top flange and bottom flange. The side flange may have a height greater than a minimum bend radius of a cable extending from the antenna system.

In a second aspect, a method may include coupling a housing of an antenna system with a bottom flange of a solid surface bracket. The bottom flange may receive a clip of the antenna system. The bottom flange may also be substantially parallel to a top flange of the solid surface bracket. The method may also include receiving a solid surface fastener in an opening of the top flange, such that the solid surface fastener is configured to couple the top flange to a solid surface ceiling. The opening in the top flange may be sized and shaped to receive the solid surface fastener. A cable may extend from the antenna housing and be routed between the top flange and the bottom flange. The cable may also have a minimum bend radius that is less than the height of a side flange extending between the top flange and the bottom flange.

In a third aspect, an apparatus may include a bottom flange, a side flange, and a top flange. The bottom flange may include a clip slot configured to receive a clip of an antenna system. The bottom flange may also have a post opening configured to receive an antenna system post. A v-score may be located at a position along the bottom flange corresponding to a size of an antenna system housing. The side flange may extend substantially perpendicular to the bottom flange from an edge of the bottom flange. The height of the side flange is greater than a minimum bend radius of a cable that extends out of the antenna system through the antenna system post. The top flange may extend substantially perpendicular to the side flange from an edge of the flange that is opposite and substantially parallel to the bottom flange. The top flange may also have an opening that is sized and shaped to receive a solid surface fastener the mounts the top flange of apparatus to a solid surface ceiling.

FIG. 1 illustrates a mounting system 10. The mounting system 10 may include a solid surface ceiling 20, an antenna system 30, and a solid surface bracket 40. Additional, different, or fewer components may be provided. For example, the mounting system 10 may include a wireless device 12 having a radio configured for wireless communication 14 with the antenna system 30. The wireless device 12 may be a laptop computer, personal digital assistant (PDA), media player, cell phone, or other communication device. In another example, a communication device 60 may be provided. The communication device 60 may receive signals from or transmit signals to the antenna system 30. In yet another example, the solid surface ceiling 20 and the antenna system 30 may not be provided in the mounting system 10. The solid surface bracket 40 may be manufactured, sold, or used independently of other components.

The solid surface ceiling 20 may be a ceiling that has a thickness and/or material that prevents through-holes from being formed and/or be a ceiling from which a suspended grid ceiling is suspended. A through-hole is an opening that extends from a first side of the solid surface ceiling 20 to a second side of the solid surface ceiling 20. The antenna system 30 may be disposed on the first side. The first side may be opposite the second side. The thickness and/or material may make it impractical to form a through-hole in the solid surface ceiling 20. For example, the solid surface ceiling 20 may be a concrete ceiling. The thickness of the concrete ceiling (e.g., from the first side to the second side) may be relatively large (e.g., three (3) feet). Drilling a through-hole in the concrete ceiling may be economically (e.g., require four hours of drilling) and/or structurally (e.g., cause structural weakness in the solid surface ceiling 20, the second side may not be fit for routing cables, or the communication device 60 is disposed on the first side) impractical.

Although the thickness and/or material may prevent a through-hole from being formed, a solid surface fastener may be configured to engage with the solid surface ceiling 20. The solid surface fastener may be a solid surface screw 22. The solid surface screw 22 may be fastened to, fixed to, screwed into, or attached to the solid surface ceiling 20. Exemplary solid surface screws 22 include concrete screws, drywall screws, or wood screws. In one embodiment, the solid surface screw 22 is a Tapcon® concrete screw. The Tapcon® concrete screw may include threads that may cut threads into a concrete ceiling. As a result, the Tapcon® concrete screw provides an excellent holding value. The solid surface screw 22 may or may not extend from a first side of the solid surface ceiling 20 to a second side of the solid surface ceiling 20. In alternative embodiments, the solid surface fastener is a clip, latch, hook, or other device for engaging the solid surface ceiling 20.

The antenna system 30 may include an antenna 32, antenna housing 34, communication system 36, and one or more clips 38 (hereinafter, clip 38). Additional, different, or fewer components may be provided. For example, the antenna system 30 may include a ground plane for shielding the antenna 32 or other components used with or in an antenna system. In another example, the clips 38 are not provided, but a screw, bolt, latch, or other connector are provided. One exemplary antenna system 30 is the Cisco Aironet Antenna 2.0 Dbi Diversity Omni Ceiling Mount Antenna (Cisco Aironet Antenna), which is sold by Cisco Technology, Inc. having a place of business in San Jose, Calif. The Cisco Aironet Antenna was designed for wireless local area network (WLAN) applications for frequencies of 2400 to 2500 mega Hertz (MHz). The Cisco Aironet Antenna includes an omni directional antenna that has a nominal gain of 2.2 dBi. The Cisco Aironet Antenna comes with a clip that permits it to be mounted to a grid rail of a suspended grid ceiling.

The antenna 32 may be used to communicate with the wireless device 12 using wireless communication 14. The antenna 32 may be a transducer designed and/or configured to transmit, receive, or both transmit and receive electromagnetic waves. The antenna 32 may convert electromagnetic waves into electrical signals and vice versa. The antenna 32 may be used in a wireless network, such as a radio broadcasting network, television broadcasting network, point-to-point radio communication network, wireless local area network (LAN), or other wireless networks. The antenna 32 may be a dipole antenna, patch antenna, or other antenna configured to communicate with a wireless device 12 in the wireless network.

The antenna housing 34 may be a shell, housing, or protection lid. The antenna housing 34 may be configured to cover the antenna 32. The antenna housing 34 has a front surface and a rear surface. All, some, or none of the rear surface may be disposed between the solid surface ceiling 20 and the front surface of the antenna system 30. In other words, when installed, the front surface may be visible from below the solid surface ceiling 20 and the rear surface may not be visible. The antenna housing 34 may be made of any material. However, in one embodiment, the antenna housing 34 is made of a material, such as plastic, that does not interfere with wireless communication between the antenna 32 and the wireless device 12. The antenna housing 34 may be any shape, such as rectangular or circular. Other shapes may be used.

The communication system 36 may include one or more cables, wires, channels, wireless communication networks, or other networks or segments for communication. In one example, the communication system 36 is a coaxial cable. In another example, the communication system 36 is a radio frequency (RF) network. The RF network may allow the antenna system 30 to operate as a wireless relay, for example, obtaining wireless signals from a first wireless device (e.g., wireless device 12) and relaying the wireless signals to a second wireless device (e.g., communication device 60). In yet another example, the wireless communication network may be an infrared network system. The antenna system 30 may communicate with the communication device 60 using infrared signals. Other wireless communication networks may be used.

The antenna 32 may be communicatively coupled with the communication device 60 via the communication system 36. The communication system 36 may be used to transmit electrical signals back and forth between the communication device 60 and antenna 32. For example, once the antenna 32 receives an electromagnetic wave and converts it into an electrical signal, the communication system 36 may transmit the electrical signal to the communication device 60. Alternatively, the communication system 36 may be used to carry electrical signals from the communication device 60 to the antenna 32. The communication device 60 may be an access point, router, server, personal computer, network switch, or other network device.

The clip 38 may be a tab, alligator clip, pin, or other attachment device. The clip 38 may be disposed on the rear surface of the antenna housing 34. The clip 38 may be designed and/or configured to attach to a grid rail in a suspended grid ceiling. For example, in one embodiment, the clip 38 is a tab of metal that is attached at one end to the antenna housing 34. The other end of the clip (i.e., the end that is not attached to the antenna housing 34) may be slid over a grid rail. The grid rail may be disposed between the clip 38 and the antenna housing 34. The clip 38 may be designed and/or configured to attach to the solid surface bracket 40.

Figure 2:
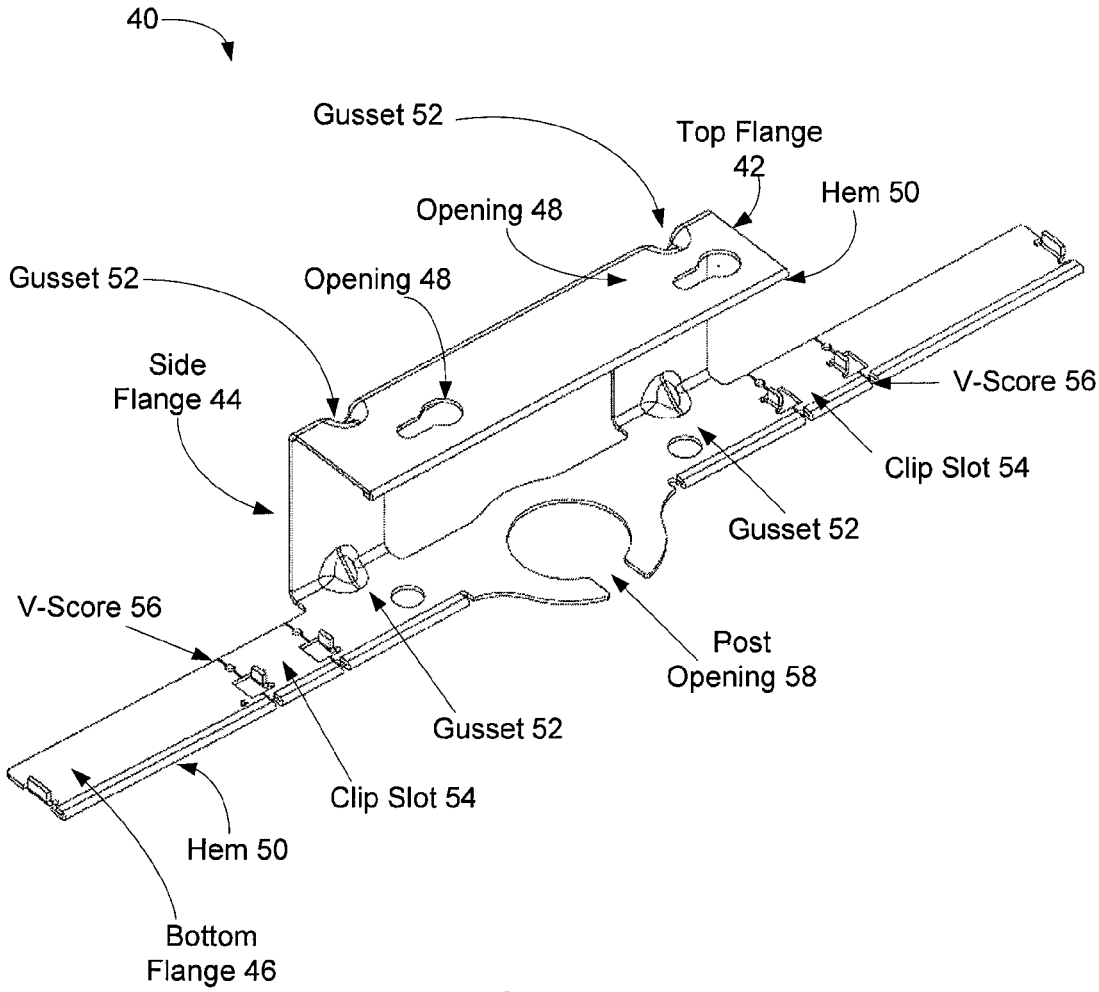
FIG. 2 illustrates one embodiment of a solid surface bracket.

FIG. 2 shows one embodiment of the solid surface bracket 40 (hereinafter, bracket 40). The bracket 40 may be an antenna support bracket, suspended grid antenna bracket or other bracket for attaching the antenna system 30 to a solid surface 20. The bracket 40 may include one or more top flanges 42 (hereinafter, top flange 42), one or more side flanges 44 (hereinafter, side flange 44), and one or more bottom flanges 46 (hereinafter, bottom flange 46). As used herein, a flange includes a rib, edge, or rim configured for attachment to another object or flange. For example, the side flange 44 may be connected to the top flange 42 and bottom flange 46. The top flange 42 may engage with the solid surface ceiling 20. The bottom flange 46 may engage with the antenna system 30. For example, the bottom flange 46 may engage with the clip 38. The clip 38 may be slid over, clipped to, or coupled with the bottom flange 46.

Additional, different, or fewer flanges 42, 44, and 46 may be provided. For example, in one embodiment, the bottom flange 46 may be removed. The side flange 44 may engage with the antenna system 30. The side flange 44 may include a slit, opening, hook, clip, connector, or other male or female connection device for attaching to the antenna system 30. For example, the side flange 44 may include an opening. The opening may be sized and shaped to receive the clip 38, such as emulating a portion of a drop ceiling grid. In another embodiment, the side flange 44 includes a hook that engages with an opening of the antenna system 30.

The top flange 42 may be substantially parallel to the bottom flange 46. The side flange 44 may extend between and/or substantially perpendicular to the top flange 42 and bottom flange 46. As used herein, the term "substantially" takes into account minor bends or deviations provided during manufacture, shipment, or installation.

The bracket 40 may be a "C" shaped bracket. Other arrangements are possible. For example, an "S" shaped bracket may be used. The flanges 42, 44, and 46 may be flat, curved, plate-like, single surface, multiple surfaces connected at angles to each other, or have other shape or configurations.

The bracket 40 may include a material suitable for supporting the antenna system 30. As used herein, "supporting the antenna system 30" may include holding the antenna system 30 without substantial deviations in the shape or structure of the bracket 40. Exemplary materials include metal, plastic, or wood. One, some, or all of the flanges 42, 44, and 46 may have the same or different material. In one example, the flanges 42, 44, and 46 are made of steel. In another example, the flanges 42, 44, and 46 are made of polyvinyl chloride (PVC). Other metals (e.g., aluminum, brass, copper, tin, nickel, titanium, silver, gold, or platinum) and plastics (e.g., acrylonitrile butadiene styrene, polycarbonate, melamine formaldehyde, or other special-purpose plastics) may be used. The material may be plated, non-plated, reinforced, not reinforced, or otherwise formed for supporting the antenna system 30.

In one embodiment, the bracket 40 is a single piece of material that is bent, cut, press brake formed, roll formed, stamped, or a combination thereof to form the flanges 42, 44, and 46. For example, the bracket 40 may be a piece of sheet metal having a gauge suitable for supporting the antenna system 30. The gauge includes thickness. The gauge may range from about 30 gauge to about 8 gauge. The higher the gauge, the thinner the metal.

In another embodiment, the flanges 42, 44, and 46 are independent pieces of material. The flanges 42, 44, and 46 may be connected to each other, for example, by soldering, gluing, or attaching.

The top flange 42 may include one or more openings 48 (hereinafter, opening 48). The opening 48 may be sized and/or shaped to receive the solid surface screw 22. As used herein, the term "sized to receive the solid surface screw 22" may include large enough to allow a shaft of the solid surface screw 22 to pass through the opening 48 and small enough to prevent a head of the solid surface screw 22 from passing through the opening 48. The opening 48 may be shaped as a key-hole, circle, oval, funnel, or square. Other shapes may be used.

The opening 48 may be formed during manufacturing or installation. For example, the opening 48 may be cut out of the bracket 40 before being sold or formed by driving the screw 22 through the top flange 42 during installation or drilling.

In one alternative embodiment, which is not shown, the opening 48 may not be provided. The top flange 42 may engage with a receptacle of the solid surface ceiling 20. The receptacle may be configured for supporting the antenna system 30 and the bracket 40. For example, the top flange 42 may include a hook. The hook may be formed into the top flange 42 with another bend or connected to the top flange 42. The receptacle may include a loop. The hook may engage with the loop for supporting the antenna system 30 and the bracket 40. In another example, the receptacle may be a sleeve. The top flange 42 may be slid into the sleeve.

As shown in FIG. 2, the top flange 42 and/or bottom flange 46 may include a hem 50. The hem 50 may be a corner or edge that is folded over to increase the height of the flange and/or remove sharp edges. The hem 50 on the bottom flange 46 may be configured to keep an antenna clip engaged. The hem 50 prevents the antenna clip from sliding off the flange 46. The hem 50 may also protect the cable 32 from being cut or torn when a cable (e.g., part of the communication system 36) rubs against the top flange 42 and/or bottom flange 46. The hem 50 may be provided on an edge that is opposite the side flange 44. In other words, the hem 50 is provided on the edge that is not being supported, for example, by the side flange 44. The hem 50 may have a rolled and/or circular profile.

A bend between the top flange 42 (and/or bottom flange 44) and the side flange 44 may include one or more gussets 52 (hereinafter, gusset 52). The gusset 50 may be a rib pressed into the bend from the outside in, which may be referred to as reverse pressing. The gusset 50 makes the bend stronger. In other words, in relation to a bend that does not have a gusset 50, a bend with a gusset 50 requires more force to change the angle of the bend.

The side flange 44 may extend between the top flange 42 and bottom flange 44. The side flange 44 may be sized to allow the cables 32 to be routed to the communication device 60. Sized to allow the cables 32 to be routed to the communication device 60 may include having a height that allows the cables 32, which extend from the rear surface of the antenna system 30, to be bent and routed substantially parallel to the rear surface of the antenna system 30 and/or solid surface ceiling 20. The height of the side flange 44 may be equal to or greater than the minimum bend radius of, for example, a coaxial cable coupling the antenna 32 with the communication device 60. A bend radius, which is measured along the inside curvature, is the minimum radius a pipe, tube, sheet, cable or hose may be bent without kinking it, damaging it, or shortening its life. The smaller the bend radius, the greater the material flexibility (i.e., as the radius of curvature decreases, the curvature increases). The minimum bend radius is the radius below which an object such as a cable should not be bent. The height of the side flange 44 is such that the coaxial cable may be bent and routed on the first side of solid surface ceiling 20. In other words, the coaxial cable may be bent and routed on the same side of the solid surface ceiling 20 as the antenna system 30. In one embodiment, the height of the side flange 44 (i.e., the distance between the top flange 42 and bottom flange 46) is 1.75 inches.

One benefit of the bracket 40 is that the height of the side flange 44 may be varied to accommodate different minimum bend radiuses. A manufacturer may define a minimum bend radius for the communication system 36. A bracket 40 may be chosen based on the defined minimum bend radius.

The bracket 40 may include a plurality of side flanges 44. The plurality of side flanges may be evenly spaced apart from each other. For example, a first side flange may be disposed at one end of the top flange 42 and a second side flange may be disposed at the other end of the top flange 42, as shown in FIG. 2. Using a plurality of side flanges 44 may reduce the weight of the bracket 40 and ensure that the bracket 40 is configured for supporting the antenna system 30.

The bottom flange 46 may include one or more clip slots 54 (hereinafter, clip slot 54). The clip slot 54 may have one or more tabs that prevent the clip 38 from moving side-to-side. The tabs may be spaced apart from each other to ensure that the clip 38 may be inserted between the tabs and does not have room for substantial movement. As used herein, substantial movement including movement that causes disruptions, for example, slipping off the bottom flange 46, wobbling back and forth, or sliding along the bottom flange 46.

The bottom flange 46 may include one or more scores 56 (hereinafter, score 56). A score 56 may be a line, such as a scratch or incision, made with or as if with a sharp instrument. The score 56 may be a starting point for breaking a portion of the bottom flange 46. The score 56 may be provided at one or more positions along the bottom flange 46. The one or more positions may be positions that are in accordance with different sizes of antenna systems 30. For example, a first antenna system may be larger in size (e.g., longer) than a second antenna system. When using the bracket 40 with the second antenna system, a user may locate and select a score 56 that corresponds to the size of the second antenna system and break the bottom flange 46 at the selected score 56, for example, by bending back and forth on the selected score 56. The score 56 may be used to tailor the size of the bracket 40 to individual antenna systems 30.

The bottom flange 46 may include one or more post openings 58 (hereinafter, post opening 58). The post opening 58 may be sized and/or shaped to receive an antenna system post. An antenna system post may be a post that extends from the antenna system 30. Cables, cords, wires, or other routing devices may be routed through the post opening 58, for example, from the inside of the antenna housing 34. The antenna system post is used to reduce the number of exposed cables, cords, and wires. The antenna system post may include threading on the outside. The post opening 58 may be sized to engage with the threading. For example, the antenna system post may be screwed into the post opening 58.

The bracket 40 may be integrated with, sold with, manufactured with, and/or coupled with the antenna system 30. For example, the bracket 40 may be manufactured as a part of the antenna system 30. In another example, the bracket 40 may be sold with the antenna system 30. Alternatively, the bracket 40 may be sold separately.

Figure 3:
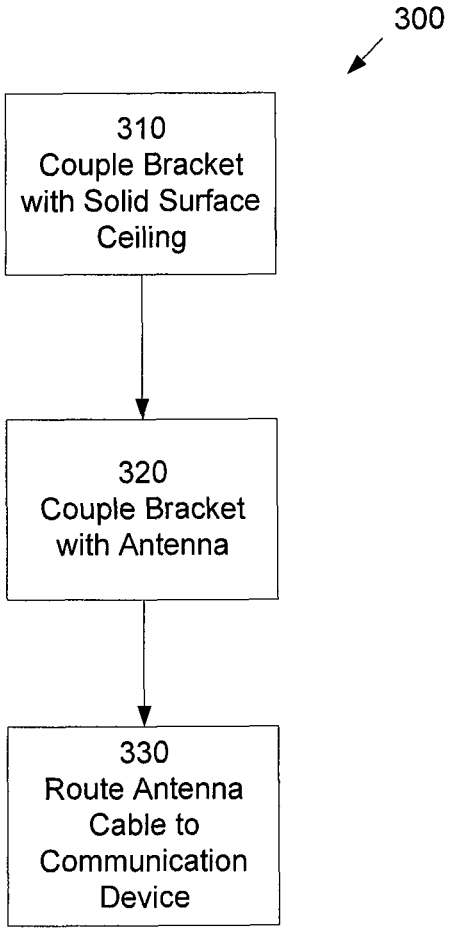
FIG. 3 illustrates one embodiment of a method for installing an antenna system.

FIG. 3 shows a method 300 for installing an antenna in a solid surface ceiling environment. The method is implemented using the mounting system 10 of FIG. 1 or a different system. The acts may be performed in the order shown or a different order. The acts may be performed automatically, manually, or the combination thereof.

In act 310, a solid surface bracket is coupled with a solid surface ceiling. Coupling may include screwing, gluing, pinning, tacking, stapling, or otherwise attaching the solid surface bracket to the solid surface ceiling. In one embodiment, coupling includes inserting a solid surface screw through an opening in the solid surface bracket and screwing the solid surface screw into the solid surface ceiling. As used herein, coupling the solid surface bracket with the solid surface ceiling may be referred to as installing the solid surface bracket. Once installed, the solid surface bracket is disposed on a first side of the solid surface ceiling.

In act 320, an antenna system is coupled with the bracket. Coupling the antenna system with the bracket may include sliding a clip, sliding the bracket, snapping, gluing, pinning, stapling, taping, or otherwise attaching the antenna system to the bracket. In one embodiment, for example, the bracket may include a flange that may be disposed between a clip, which is attached to a rear surface of the antenna, and the antenna system. In other words, the clip may be slid over the flange. In another embodiment, the bracket may be snapped to the antenna system. Any variation of snap connectors may be used for snapping.

In act 330, antenna cables are routed to a communication device. The communication cables may be routed on the first side of the solid surface ceiling. Routing the communication cable may include bending the communication cable extending from a rear surface of the antenna system, routing the communication cable along the solid surface ceiling, and connecting the communication cable to the communication device. Once connected, the communication device may be configured to communicate with a wireless device using the antenna system.

Figure 4A:
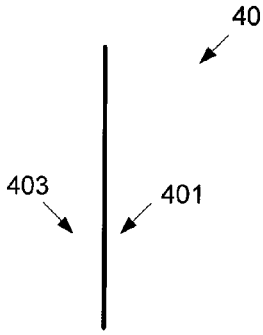
FIGS. 4*a*-4*d* illustrate a method of manufacturing a solid surface bracket.
Figure 4B:
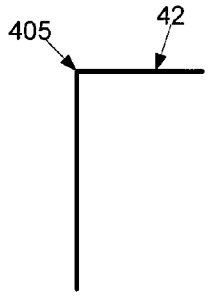
Figure 4C:
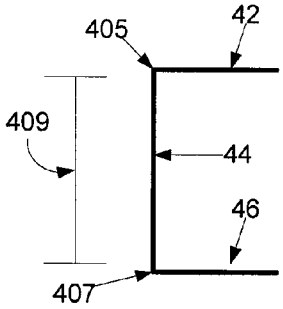

FIGS. 4*a*-4*d* show a bracket 40 during a method of manufacturing the bracket 40. FIG. 4*a* illustrates the bracket 40 as a single piece of sheet metal without any bends or breaks. The bracket 40 may include a first side 401 and a second side 403. The first side 401 may be opposite and substantially parallel to the second side 403. As shown in FIG. 4*b*, the sheet metal may be bent, for example, using a press brake, to create a top flange 42 and a first bend 405. The top flange 42 may be substantially perpendicular to the remaining portion (i.e., the portion of the bracket 40 that is substantially perpendicular to the top flange 42) of the bracket 40. One or more gussets 52 may be provided, for example, using a punch device, in the first bend 405. One or more openings 48 may be stamped out of the top flange 42. The one or more openings 48 may be sized to receive a solid surface screw 22. As shown in FIG. 4*c*, the remaining portion of the bracket 40 may be bent, for example, using a press brake, to create a bottom flange 46 and a second bend 407. The second flange 409 may be substantially parallel to the first flange 405 and perpendicular to the remaining portion of the bracket 40. The remaining portion of the bracket may be the side flange 44. The side flange 44 may have a height 409 (i.e., the distance between the first bend 405 and second bend 407) that is greater than a minimum turn radius of a cable extending from the rear surface of an antenna. One or more gussets may be provided, for example, using a punch device, in the first bend 407. The bottom flange 46 may be scored. The top flange 42 may have the same or different length as the bottom flange 46.

Figure 4D:
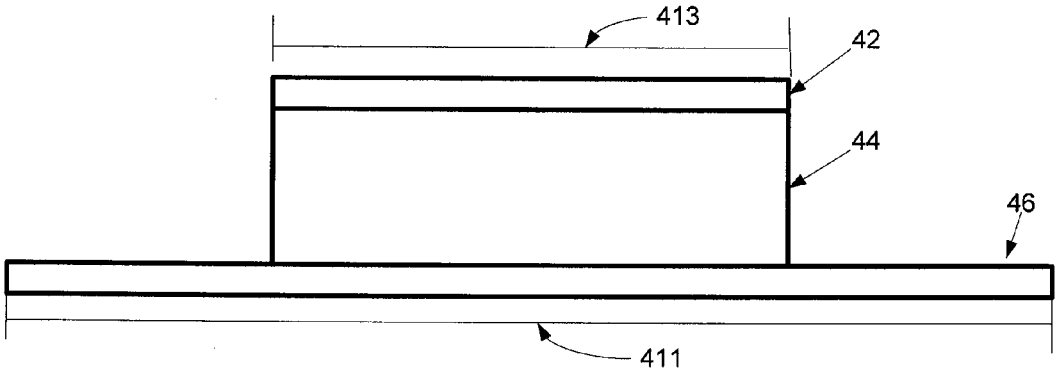

FIG. 4*d* shows a side view of the bracket 40. As shown in FIG. 4*d*, the bottom flange 46 may have a length 411 (i.e., a distance along an edge that is opposite the side flange 44) that is greater than the length 413 of the top flange 42. Alternatively, as shown in FIG. 1, the length 413 of the bottom flange 46 may be equal to or almost equal to the length 411 of the top flange 42.

Various embodiments described herein can be used alone or in combination with one another. The forgoing detailed description has described only a few of the many possible implementations of the present invention. For this reason, this detailed description is intended by way of illustration, and not by way of limitation. It is only the following claims, including all equivalents that are intended to define the scope of this invention.

The invention claimed is:

1. A solid surface bracket for coupling an antenna system with a solid surface ceiling, the solid surface bracket comprising:

a top flange having an opening that is sized and shaped to receive a solid surface fastener configured to engage with the solid surface ceiling;

a bottom flange configured to receive a clip of the antenna system, the bottom flange extending substantially parallel to the top flange; and a side flange coupled with the top flange and bottom flange, the side flange extending between the top flange and bottom flange, the side flange having a height greater than a minimum bend radius of a cable extending from the antenna system.

2. The solid surface bracket as claimed in claim 1, wherein the side flange extends substantially perpendicular to the top flange and bottom flange and the height of the side flange is a distance between the top flange and bottom flange.

3. The solid surface bracket as claimed in claim 2, wherein the height of the side flange is variable to accommodate the minimum bend radius of the cable.

4. The solid surface bracket as claimed in claim 1, wherein the solid surface ceiling is a concrete ceiling and the solid surface fastener is a concrete screw configured to make threads in the concrete ceiling.

5. The solid surface bracket as claimed in claim 1, wherein the top flange, side flange, and bottom flange are suitable for holding the antenna system without substantial deviations in shape or structure of the top, side, and bottom flanges.

6. The solid surface bracket as claimed in claim 1, wherein the bottom flange includes a clip slot configured to receive the clip of the antenna system.

7. The solid surface bracket as claimed in claim 6, wherein the clip slot prevents substantial movement of the clip.

8. The solid surface bracket as claimed in claim 1, wherein the bottom flange includes a v-score configured at a position that corresponds to a size of a housing of the antenna system.

9. The solid surface bracket as claimed in claim 8, further comprising a hem on an edge of the bottom flange or the top flange, the edge being located opposite the side flange.

10. The solid surface bracket as claimed in claim 1, wherein the bottom flange includes a post opening configured to receive an antenna system post, the antenna system post being configured to route cables from inside of the antenna system.

11. The solid surface bracket as claimed in claim 1, further comprising a gusset in an edge of the side flange proximate to where the side flange meets the bottom flange.

12. The solid surface bracket as claimed in claim 1, wherein the solid surface ceiling is a ceiling having a thickness that prevents a through-hole being formed in the ceiling.

13. The solid surface bracket as claimed in claim 1, wherein the side flange comprises a first side flange disposed at a first end of the top flange and a second side flange disposed at a second end of the top flange.

14. A method comprising:

coupling a housing of an antenna system with a bottom flange of a solid surface bracket, wherein the bottom flange is configured to extend substantially parallel to a top flange of the solid surface bracket;

receiving a solid surface fastener in an opening in the top flange of the bracket such that the solid surface fastener is configured to couple the top flange of the solid surface bracket to a solid surface ceiling, wherein the opening in the top flange is sized and shaped to receive the solid surface fastener; and routing a cable extending from the antenna housing between the top flange and the bottom flange, the cable having a minimum bend radius that is less than a height of a side flange extending between the top and bottom flange.

15. The method as claimed in claim 14, further comprising adjusting the height of the side flange to accommodate the minimum bend radius of the cable.

16. The method as claimed in claim 14, wherein coupling the antenna housing to the solid surface ceiling comprises receiving a clip of the antenna system in a clip slot of the bottom flange.

17. The method as claimed in claim 14, further comprising aligning the housing with a v-score in the bottom flange, the v-score disposed at a position corresponding to a size of the housing.

18. The method as claimed in claim 14, wherein coupling the housing with the bottom flange comprises disposing the top flange and the bottom flange substantially between the solid surface ceiling and the housing.

19. The method as claimed in claim 14, wherein coupling the housing with the bottom flange comprises receiving an antenna system post through a post opening in the bottom flange, the antenna system post being configured to route cables from inside of the antenna system.

20. An apparatus comprising:

a bottom flange comprising a clip slot configured to receive a clip of an antenna system, a post opening configured to receive an antenna system post, and a v-score located at a position along the bottom flange corresponding to a size of an antenna system housing;

a side flange extending substantially perpendicular to the bottom flange from an edge of the bottom flange, the side flange having a height greater than a minimum bend radius of a cable extending out of the antenna system through the antenna system post; and a top flange extending substantially perpendicular to the side flange from an edge of the side flange opposite and substantially parallel to the bottom flange, the top flange having an opening that is sized and shaped to receive a solid surface fastener configured to mount the top flange to a solid surface ceiling.

* * * * *